US011136784B2

(12) United States Patent
Ozawa

(10) Patent No.: US 11,136,784 B2
(45) Date of Patent: Oct. 5, 2021

(54) OUTDOOR STRUCTURE

(71) Applicant: MARVEL CORPORATION, Fukui (JP)

(72) Inventor: Seisuke Ozawa, Fukui (JP)

(73) Assignee: MARVEL CORPORATION, Fukui (JP)

( * ) Notice: Subject to any disclaimer, the term of this patent is extended or adjusted under 35 U.S.C. 154(b) by 0 days.

(21) Appl. No.: 16/973,070

(22) PCT Filed: Aug. 16, 2019

(86) PCT No.: PCT/JP2019/032188

§ 371 (c)(1),
(2) Date: Dec. 8, 2020

(87) PCT Pub. No.: WO2020/040064

PCT Pub. Date: Feb. 27, 2020

(65) Prior Publication Data

US 2021/0246647 A1 Aug. 12, 2021

(30) Foreign Application Priority Data

Aug. 18, 2018 (JP) ..... JP2018-153768

(51) Int. Cl.
*A47C 11/00* (2006.01)
*E04H 17/14* (2006.01)
(Continued)

(52) U.S. Cl.
CPC ..... *E04H 17/1465* (2021.01); *A47C 1/14* (2013.01); *A47C 4/022* (2013.01); *A47C 5/04* (2013.01);
(Continued)

(58) Field of Classification Search
CPC ..... E04H 17/1465; A47C 7/028; A47C 7/024; A47C 7/285; A47C 7/16; A47C 4/022;
(Continued)

(56) References Cited

U.S. PATENT DOCUMENTS 34,246 A * 1/1862 Edwards et al. ..... E04H 17/16 256/31
371,091 A * 10/1887 Miller ..... B60N 2/3084 297/112
(Continued)

FOREIGN PATENT DOCUMENTS

CN 201709836 U 1/2011
DE 698183 C * 11/1940 ..... A47C 4/03
(Continued)

OTHER PUBLICATIONS

International Search Report issued in International Patent Application No. PCT/JP2019/032188, dated Nov. 12, 2019 and English language translation.
(Continued)

*Primary Examiner* — Robert Canfield
(74) *Attorney, Agent, or Firm* — Greenblum & Bernstein, P.L.C.

(57) ABSTRACT

This outdoor structure, which is installed outdoors, such as a bench, a fence, or a wooden path, includes a plurality of metal support posts each including one or more rectangular through holes and arrayed at least in one row in a first direction; and a wooden slat laid across the through holes of the plurality of support posts, in which a cross section of each of the through holes in the first direction includes tapered portions which are narrow at an approximately center portion and become wider toward outside.

7 Claims, 6 Drawing Sheets

(51) Int. Cl.

| | |
|---|---|
| ***E04B 1/00*** | (2006.01) |
| ***A47C 7/02*** | (2006.01) |
| ***A47C 5/04*** | (2006.01) |
| ***A47C 1/14*** | (2006.01) |
| ***A47C 4/02*** | (2006.01) |
| ***A47C 7/16*** | (2006.01) |
| ***A47C 7/28*** | (2006.01) |

(52) U.S. Cl.
CPC ..... *A47C 7/02* (2013.01); *A47C 7/024* (2013.01); *A47C 7/028* (2013.01); *A47C 7/16* (2013.01); *A47C 7/285* (2013.01); *A47C 11/00* (2013.01); *E04B 1/003* (2013.01)

(58) Field of Classification Search
CPC .. A47C 7/02; A47C 11/00; A47C 1/14; A47C 5/04; E04B 1/003
USPC ..... 297/440.13, 440.14, 440.2, 452.63, 233, 297/236; 52/483.1, 664, 650.3, 775, 781; 256/65.01, 65.02, 65.11; D6/359
See application file for complete search history.

(56) References Cited

U.S. PATENT DOCUMENTS

| | | | | | |
|---|---|---|---|---|---|
| 839,545 | A * | 12/1906 | Brinely | E04F 11/181 256/70 |
| D68,819 | S * | 11/1925 | Malley | D6/359 |
| D80,173 | S * | 12/1929 | Girrard | D6/359 |
| 3,909,064 | A * | 9/1975 | Payne, Jr. | A47C 3/029 297/440.23 |
| 5,660,436 | A * | 8/1997 | Wilson | A47C 1/023 297/233 |
| D434,236 | S * | 11/2000 | Addleman | D21/619 |
| 7,134,728 | B1 * | 11/2006 | Buhrman | A47C 3/34 297/440.14 |
| 9,565,946 | B1 * | 2/2017 | Watton | A47C 7/024 |
| 2016/0106219 | A1 * | 4/2016 | Stirling | A47C 11/00 297/440.2 |

FOREIGN PATENT DOCUMENTS

| | | | | |
|---|---|---|---|---|
| FR | 339481 | A * | 6/1904 | E04H 17/1465 |
| FR | 2082497 | A5 * | 12/1971 | E04H 17/1413 |
| GB | 756188 | A * | 8/1956 | A47C 11/00 |
| GB | 1228578 | A * | 4/1971 | A47C 11/00 |
| JP | 9-23948 | A | 1/1997 | |
| JP | 2010-187830 | A | 9/2010 | |
| JP | 2018-29640 | A | 3/2018 | |
| KR | 10-1007755 | B1 | 1/2011 | |

OTHER PUBLICATIONS

Written Opinion issued in International Patent Application No. PCT/JP2019/032188, dated Nov. 12, 2019 and English language translation.

* cited by examiner

OUTDOOR STRUCTURE

TECHNICAL FIELD

The present invention relates to outdoor structures installed outdoors, such as benches, fences, and wooden paths, and more particularly relates to outdoor structures each composed of a combination of metal frames and wooden slats.

BACKGROUND ART

Heretofore, outdoor structures such as benches, fences, wooden paths, and so on are installed in outdoor places such as parks and plazas. Such an outdoor structure is, for example, composed of a combination of metal frames (such as leg parts and support posts) and wooden slats, in which multiple metal frames are fixed with anchor bolts to base blocks built in the ground and wooden slats are laid between the frames.

For example, Patent Literature 1 describes a bench composed of leg parts (frames) each integrally formed of a metal casting, and a seat and a backrest which are formed of slats laid between the leg parts.

CITATION LIST

Patent Literature

[PTL 1] Japanese Patent Application Publication No. 2018-029640

SUMMARY OF INVENTION

Technical Problems

The bench of Patent Literature 1 includes the seat and the backrest and has a minimum function as a bench. Benches installed, for example, in parks and plazas where children gather, however, are required to have more attractive designs in addition to the function as a bench.

The bench of Patent Literature 1 has the structure in which both ends of the slats are supported by the leg parts. When this structure is used to build a longer bench, it is necessary to increase the strength of the slats or provide a middle leg part between both end leg parts in order to prevent the slats from bending. In this case, the middle leg part is different in shape from both end leg parts and requires another casting mold. This also causes a problem of significant cost increase.

The present invention was made in view of the above circumstances, and has an object to provide an outdoor structure which is easy to change in design such as a change in size or length and has a high degree of freedom in design.

Solution to Problems

In order to achieve the above object, an outdoor structure of the present invention includes a plurality of metal support posts each including one or more rectangular through holes and arrayed at least in one row in a first direction; and a wooden slat laid across the through holes of the plurality of support posts, in which a cross section of each of the through holes in the first direction includes tapered portions which are narrow at an approximately center portion and become wider toward outside.

In this structure, the slat is supported by the through holes in the support posts. Thus, various designs may be applied to the support post without significantly changing the positions of the through holes. In addition, the structure requires only one type of support posts. Then, it is possible to construct an outdoor structure having a length as needed by changing the number of support posts or changing the length of the slats. Moreover, since the through hole is provided with the tapered portion, rainwater or the like, even if soaked into the slat at this portion, is easily dried. Thus, an outdoor structure less likely to rot can be obtained.

Moreover, each of the support posts may include flanges along one sides of the through holes, the flanges formed to protrude in the first direction and a direction opposite to the first direction, and the slat may be fixed with fixing members inserted through the flanges.

In addition, an angle of each of the tapered portions is preferably 3 to 45°.

Moreover, it is desirable to apply a certain design to each of the support posts.

Further, it is desirable that each of the support posts include a plurality of the through holes arranged consecutively in an approximately L-form, a plurality of the slats be laid corresponding to the respective through holes, and the outdoor structure be a bench in which a seat face and a backrest are formed of the plurality of slats.

Moreover, it is desirable that each of the support posts include a plurality of the through holes arranged at predetermined intervals in a vertical direction, a plurality of the slats be laid corresponding to the respective through holes, and the outdoor structure be a fence in which horizontal plates are formed of the plurality of slats.

Furthermore, it is desirable that the plurality of support posts be arranged in M (M is an integer of 2 or more) rows each including N (N is an integer of 2 or more) support posts arrayed along the first direction, the M rows arranged in a second direction orthogonal to the first direction, a plurality of the slats be M girders laid across the through holes in the N support posts arrayed along the first direction, and the outdoor structure be a deck or wooden path further including: a plurality of wooden joists laid across the M girders; and a plurality of wooden deck materials laid on top of the plurality of joists.

Advantageous Effect of Invention

According to the present invention, an outdoor structure which is easy to change in design such as a change in size or length and has a high degree of freedom in design is achieved as described above.

DESCRIPTION OF EMBODIMENTS

Figure 1:
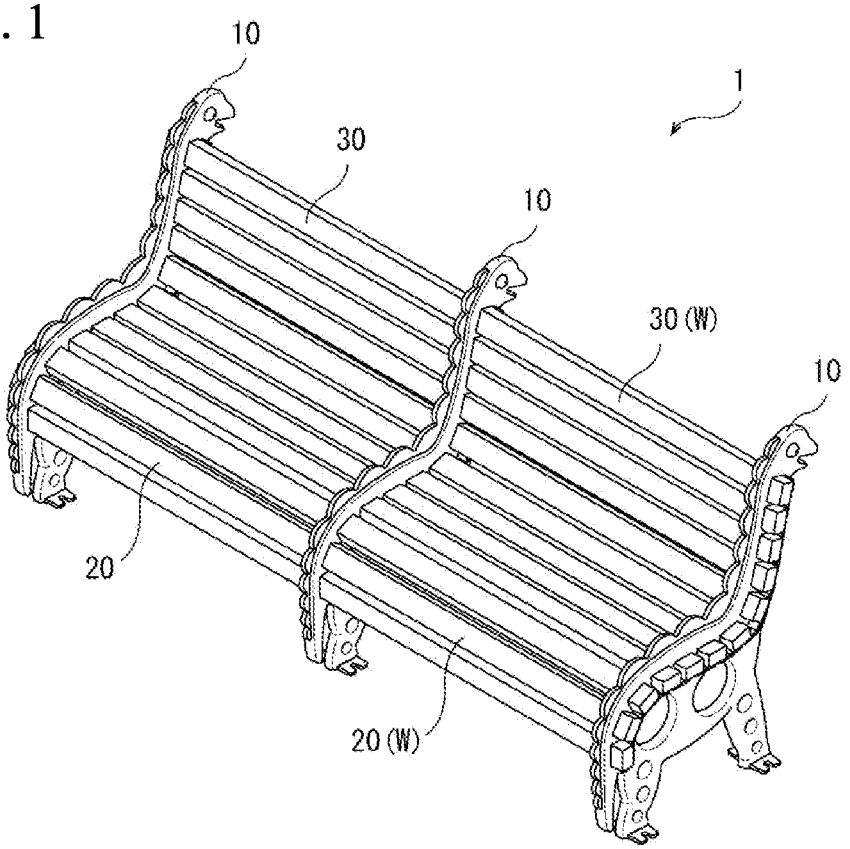
FIG. 1 is a perspective view illustrating a structure of a bench (outdoor structure) according to a first embodiment of the present invention.

Hereinafter, embodiments of the present invention will be described with reference to the drawings. Note that, unless otherwise specified, constituent elements, types, combinations, materials, shapes, relative arrangements, and so on described in these embodiments are not intended to limit the scope of the invention only to them, but are described as merely explanatory examples. Here, the same or equivalent portions in the drawings are assigned with the same reference sign and their repetitive explanation is omitted.

First Embodiment

FIG. 1 is a perspective view illustrating a structure of a bench 1 (outdoor structure) according to a first embodiment of the present invention. As illustrated in FIG. 1, the bench 1 of the present embodiment is one installed in an outdoor place such as a park or plaza, and includes three frames 10 (support posts) in a dinosaur-like shape, and seat faces 20 and backrests 30 formed between the frames 10. In the present embodiment, the seat faces 20 and the backrests 30 are formed of 12 wooden slats W (for example, a length: 1800 mm, a width: 55 mm, and a thickness: 34 mm) laid across the frames 10.

Figure 2B:
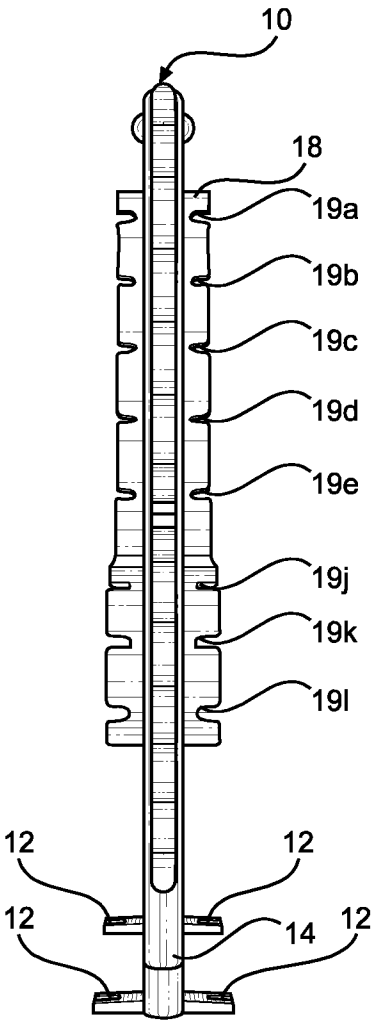
FIG. 2A and FIG. 2B presents views illustrating a structure of a frame of the bench according to the first embodiment of the present invention.
Figure 2A:
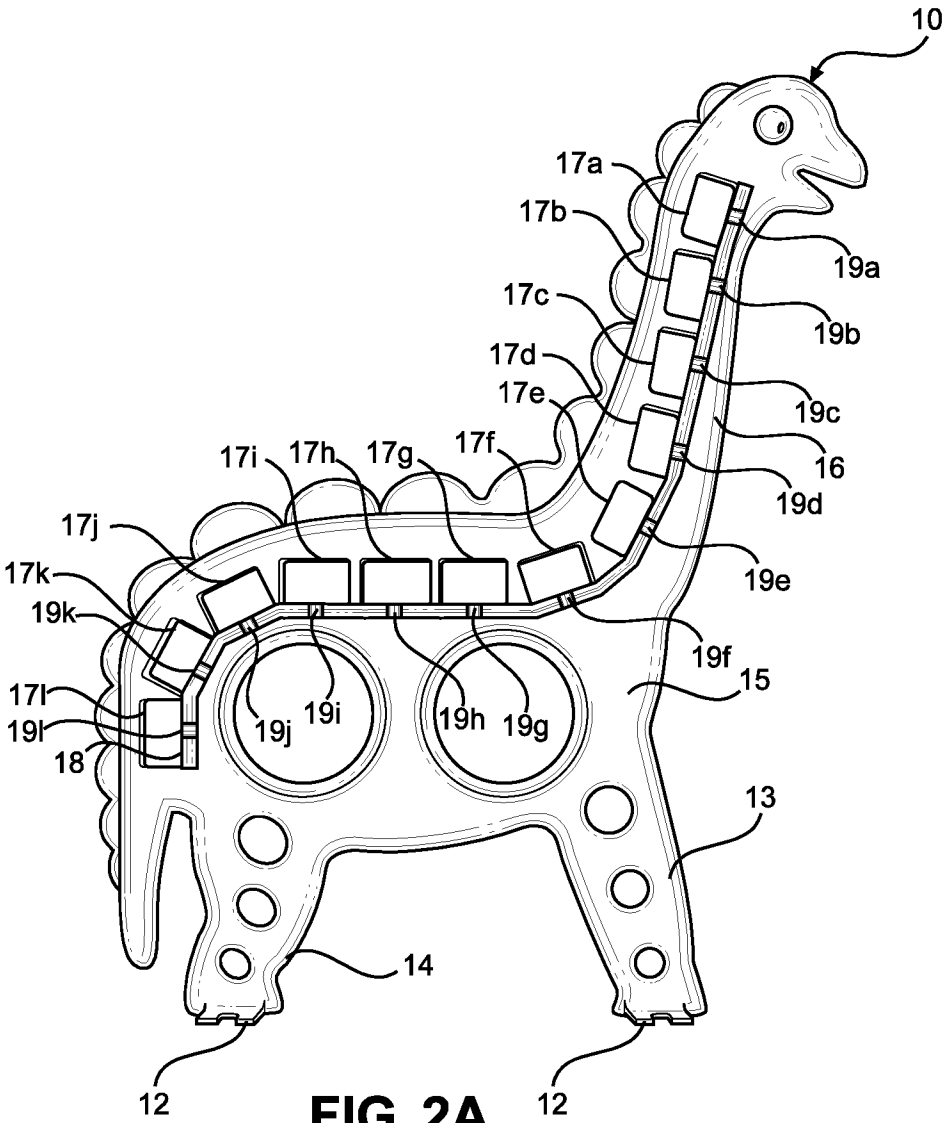

FIG. 2A and FIG. 2B present views illustrating a structure of the frame 10, in which FIG. 2A is a right-side view and FIG. 2B is a front view. The frame 10 is a plate-form member integrally formed of a metal casting, and includes bases 12 fixed with anchor bolts or the like to base blocks (not illustrated) built in the ground, leg parts 13 and 14 erected on the bases 12, a main body 15 located on top of the leg parts 13 and 14, an extension part 16 extending from the main body 15 obliquely upward (obliquely upward to the right in FIG. 2A), 12 rectangular through holes 17*a* to 17*l* formed in the main body 15 and the extension part 16, flanges 18 protruding on both sides of the frame 10 (the right and left sides in FIG. 2B) so as to extend along one sides of the through holes 17*a* to 17*l*, notches 19*a* to 19*l* formed in each of the flanges 18 at positions corresponding to the through holes 17*a* to 17*l*, and so on. Here, as illustrated in FIG. 2A and FIG. 2B, the frame 10 of the present embodiment is in a dinosaur-like design, in which the main body 15 corresponds to the body of the dinosaur, the extension part 16 corresponds to the neck of the dinosaur, and the leg parts 13 and 14 correspond to the legs of the dinosaur, and the through holes 17*a* to 17*l* are arranged consecutively in an approximately L-form (an inverted L-form in FIG. 2A) along the spine of the dinosaur.

The through holes 17*a* to 17*e* are holes through which the slats W for the backrests 30 are inserted. The slats W are inserted through the through holes 17*a* to 17*e* and fixed with wood screws (not illustrated) attached at the positions of the notches 19*a* to 19*e*.

The through holes 17*f* to 17*l* are holes through which the slats W for the seat faces 20 are inserted. The slats W are inserted through the through holes 17*f* to 17*l* and fixed with wood screws (not illustrated) attached at the positions of the notches 19*f* to 19*l*.

Figure 3:
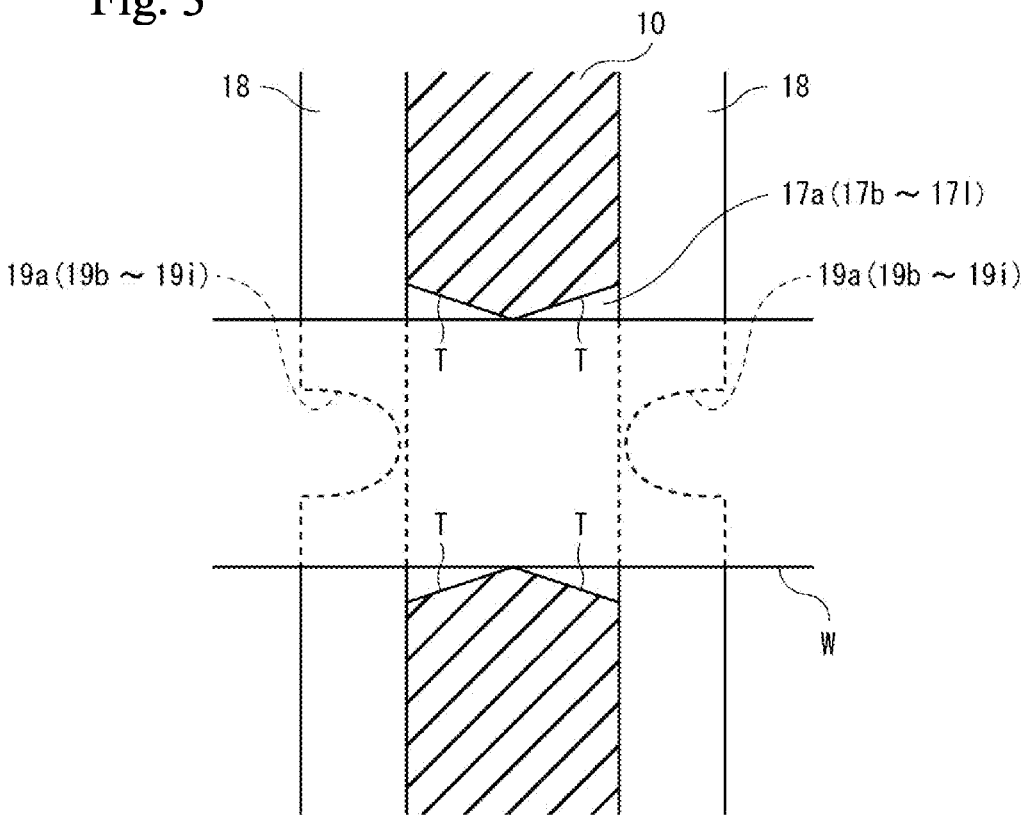
FIG. 3 is a diagram for explaining a positional relationship between each of through holes formed in the frame and a slat in the bench according to the first embodiment of the present invention.

FIG. 3 is a cross-sectional view of an area around the through hole 17*a* to 17*l* for explaining a positional relationship between the through hole 17*a* to 17*l* and the slat W. As described above, the slats W in the present embodiment are inserted through the through holes 17*a* to 17*l* in the three frames 10 and are fixed with the wood screws (not illustrated) attached to the notches 19*a* to 19*l* in the flanges 18. In this connection, when the cross-sectional shape of each of the through holes 17*a* to 17*l* is approximately equal to the cross-sectional shape of each slat W, the contact area of the through hole 17*a* to 17*l* with the slat W in the process of insertion is so large that a problem arises in that it is difficult to insert the slat W through the through hole 17*a* to 17*l*. Meanwhile, when a gap between the slat W and the through hole 17*a* to 17*l* is too small, there is another problem that rainwater or the like, if soaked into the slat W at this portion, is difficult to dry and easily rots the slat W. To solve these problems, in the present embodiment, each of the through holes 17*a* to 17*l* has a structure in which tapered portions T at an angle of 3 to 45° are provided inside the through hole 17*a* to 17*l* and the cross section of the through hole 17*a* to 17*l* is narrow at an approximately center portion (inner side) and becomes wider toward the outside. With this structure, the contact areas of the through holes 17*a* to 17*l* with the slats W in the process of insertion are small and accordingly it is easy to insert the slats W into the through holes 17*a* to 17*l* (in other words, the assembling work is easy). Then, since each through hole 17*a* to 17*l* becomes wider toward the outside, the air permeability is good. For this reason, even if rainwater or the like soaks into the slat W at this portion, the slat W is less likely to rot.

As described above, in the bench 1 of the present embodiment, the slats W for the seat faces 20 and the backrests 30 are inserted through and fixed to the through holes 17*a* to 17*l* of the three frames 10 and thereby the slats W are laid across the three frames 10. This structure only requires manufacturing of one type of frames 10, and accordingly significantly reduces the manufacturing cost for molds. In addition, longer slats W can be used by increasing the number of frames 10, so that benches 1 having various lengths can be manufactured (in other words, a design change is easy). Further, since the frame 10 is provided with the flanges 18 protruding on both sides, the frame 10 is capable of joining two slats W with the frame 10 interposed in between. Therefore, benches 1 having various lengths can be manufactured by additionally joining slats W in a longitudinal direction. Moreover, since the bench 1 of the present embodiment has the structure in which the slats W for the seat faces 20 and the backrests 30 are supported by the through holes 17*a* to 17*l*, various designs may be applied to the main body 15 and the extension part 16 without significantly changing the positions of the through holes 17*a* to 17*l* (for example, a design of a giraffe, elephant, or the like instead of the dinosaur design) (in other word, the degree of freedom in design is high).

The above description is for explaining the embodiment and example of the present invention, but the present invention is not limited to the aforementioned structure, but may be modified in various ways within the scope of the technical idea of the present invention.

For example, the present embodiment employs the structure using 12 wooden slats W for the seat faces 20 and the backrests 30, but the structure is not limited to the above structure and the number and the size of slats W may be modified as appropriate with the strength and so on taken into consideration. Furthermore, as the slat W, a preservative-treated wooden material may be used.

Second Embodiment

Figure 4A:
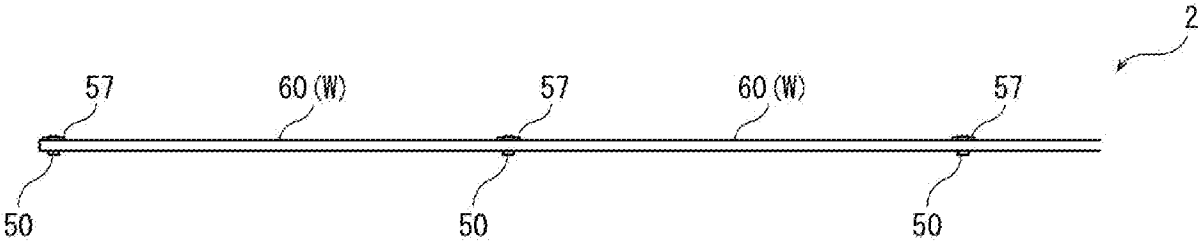
FIG. 4A, FIG. 4B, and FIG. 4C present views illustrating a structure of a fence (outdoor structure) according to a second embodiment of the present invention.
Figure 4B:
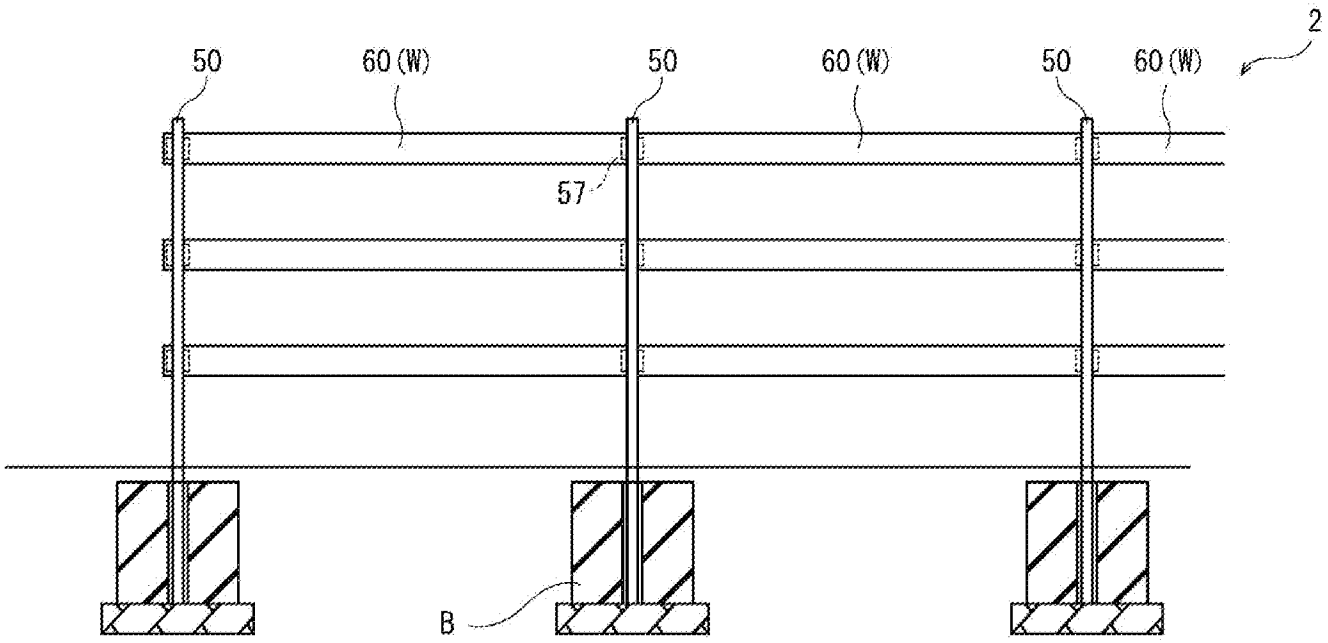
Figure 4C:
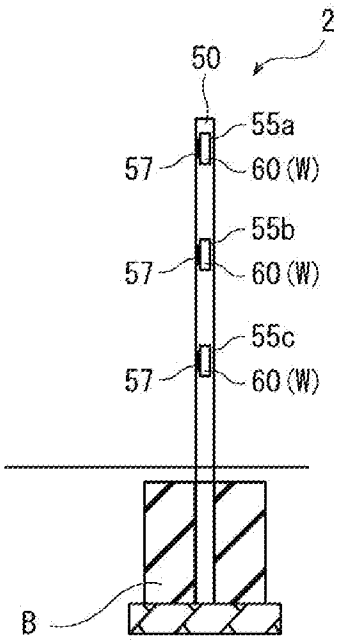

FIG. 4A, FIG. 4B, and FIG. 4C present views illustrating a structure of a fence 2 (outdoor structure) according to a second embodiment of the present invention. FIG. 4A is a plan view (top view), FIG. 4B is a front view, and FIG. 4C is a left-side view. As illustrated in FIG. 4A, FIG. 4B, and FIG. 4C, the fence 2 of the present embodiment includes multiple support posts 50 installed at predetermined intervals in a single row, and horizontal plates 60 laid across the support posts 50. In the present embodiment, each horizontal plate 60 is formed of a wooden slat W (for example, a length: 1800 mm, a width: 99 mm, and a thickness: 34 mm) laid across the support posts 50.

The support post 50 is a columnar member formed of a metal casting and having, for example, a length: 1600 mm, a width: 60 mm, and a thickness: 35 mm. A bottom end portion (for example, 450 mm) of the support post 50 is fixed to a base block B built in the ground, while a tip end side (for example, 1150 mm) is exposed above the ground. Then, in the tip end side of the support post 50 (that is, the portion exposed above the ground), three through holes 55*a* to 55*c* in a rectangular shape which is long in a vertical direction are formed at predetermined intervals (for example, 350 mm) in the vertical direction, and flanges 57 protruding on both sides of the support post 50 (the right and left sides in FIG. 4B) are formed along one long sides of the through holes 55*a* to 55*c* (the left long sides in FIG. 4C).

The through holes 55*a* to 55*c* are holes into which the slats W of the horizontal plates 60 are fitted, and are configured such that the slats W are inserted through and fixed to the through holes 55*a* to 55*c* in the support post 50 located at the outermost position (the leftmost position in FIGS. 4A and 4B), two slats W are fitted into the through holes 55*a* to 55*c* in each of the other support posts 50 from the right and left directions, and thus the support post 50 joins the two slats W arranged in the right and left directions. In other words, in the present embodiment, the slats W inserted through the through holes 55*a* to 55*c* in the support post 50 located at the outermost position (the leftmost position in FIGS. 4A and 4B) are slightly longer than the other slats W and the end portions of the slats W protrude from the support post 50 located at the outermost position. Then, the slats W fitted into the through holes 55*a* to 55*c* are fixed with wood screws 62 (not illustrated in FIG. 4A, FIG. 4B and FIG. 4C) inserted therein via through holes (not illustrated) formed in the flanges 57.

Figure 5:
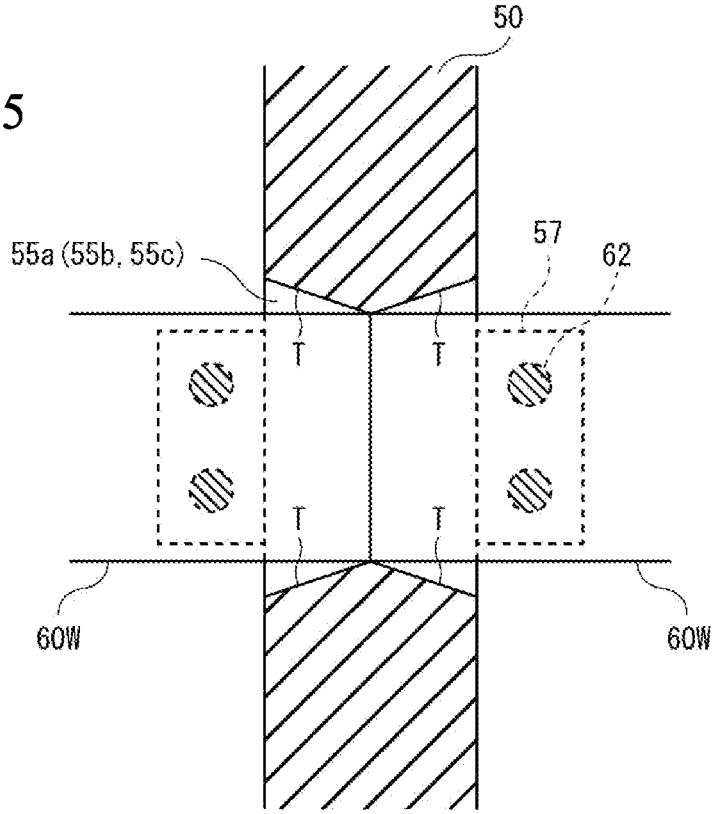
FIG. 5 is a diagram for explaining a positional relationship between each of through holes formed in a support post and a slat in the fence according to the second embodiment of the present invention.

FIG. 5 is a cross-sectional view of an area around the through hole 55*a* to 55*c* for explaining a positional relationship between the through hole 55*a* to 55*c* and the slat W. As described above, the slats W in the present embodiment are fitted into the through holes 55*a* to 55*c* in the support post 50 from the right and left directions, and are fixed with the wood screws 62 inserted therein via the through holes in the flanges 57. In this connection, when the cross-sectional shape of each of the through holes 55*a* to 55*c* is approximately equal to the cross-sectional shape of each slat W, the contact area of the through hole 55*a* to 55*c* with the slat W in the process of fitting is so large that a problem arises in that it is difficult to fit the slat W into the through hole 55*a* to 55*c*. Meanwhile, when a gap between the slat W and the through hole 55*a* to 55*c* is too small, there is another problem that rainwater or the like, if soaked into the slat W at this portion, is difficult to dry and easily rots the slat W. To solve these problems, in the present embodiment, each of the through holes 55*a* to 55*c* has a structure in which tapered portions T at an angle of 3 to 45° are provided inside the through hole 55*a* to 55*c* and the cross section of the through hole 55*a* to 55*c* is narrow at an approximately center portion (inner side) and becomes wider toward the outside. With this structure, the contact areas of the through holes 55*a* to 55*c* with the slats W in the process of fitting are small and accordingly it is easy to fit the slats W into the through holes 55*a* to 55*c* (in other words, the assembling work is easy). Then, since each through hole 55*a* to 55*c* becomes wider toward the outside, the air permeability is good. For this reason, even if rainwater or the like soaks into the slat W at this portion, the slat W is less likely to rot.

In the fence 2 of the present embodiment, the slats W are fitted and fixed to the through holes 55*a* to 55*c* in the multiple support posts 50, and thereby are laid across the support posts 50 as described above. This structure only requires manufacturing of one type of support posts 50. In addition, the structure in which the support post 50 joins two slats W makes it possible to construct fences 2 having various lengths by adjusting the number of support posts 50 and the length of the slats W (in other words, a design change is easy). Moreover, as in the bench 1 of the first embodiment, various designs may be applied to the support post 50 without significantly changing the positions of the through holes 55*a* to 55*c* (in other word, the degree of freedom in design is high).

Third Embodiment

Figure 6:
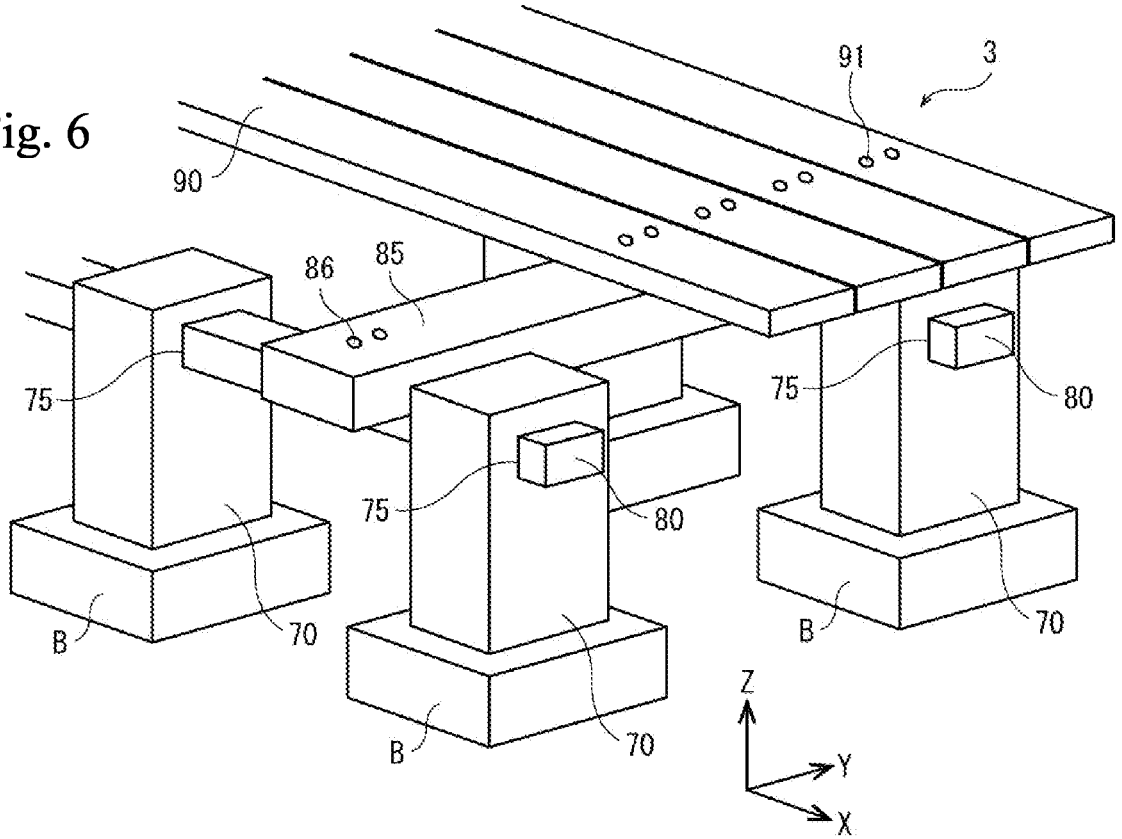
FIG. 6 is a perspective view illustrating a structure of a deck (outdoor structure) according to a third embodiment of the present invention.

FIG. 6 is a perspective view illustrating a structure of a deck 3 (outdoor structure) according to a third embodiment of the present invention. As illustrated in FIG. 6, the deck 3 of the present embodiment includes multiple support posts 70 arranged two-dimensionally at predetermined intervals, multiple girders 80 laid across the support posts 70, multiple joists 85 laid across the girders 80, and deck materials 90 laid on top of the joists 85, and so on. In the present embodiment, the following description is provided with the definitions in which an X-axis direction is an extending direction (longitudinal direction) of the girders 80, a Y-axis direction is an extending direction (longitudinal direction) of the joists 85, and a Z-axis direction is an extending direction (longitudinal direction) of the support posts 70. FIG. 6 illustrates the deck materials 90 some of which are omitted for convenience of description, but in fact the deck materials 90 are laid to fully cover the support posts 70, the girders 80, and the joists 85.

The support post 70 is a columnar member formed of a metal casting and having, for example, a length: 350 mm, a width: 90 mm, and a thickness: 35 mm, and a bottom end portion of the support post 70 is fixed with anchor bolts or the like (not illustrated) to a base block B built in the ground. A tip end portion of each support post 70 is provided with a rectangular through hole 75 through which the girder 80 is inserted, and flanges 77 protruding on both sides of the support post 70 (the plus and minus sides in the X-axis direction) are formed along a lower side of the through hole 75. Here, the support posts 70 of the present embodiment are arranged in M (M is an integer of 2 or more) rows each including N (N is an integer of 2 or more) support posts 70 arrayed at predetermined intervals in the X-axis direction (for example, 876.5 mm), the M rows arranged at predetermined intervals (for example, 876.5 mm) in the Y-axis direction.

The through hole 75 is a hole through which the girder 80 is inserted. The girder 80 is inserted through the through hole 75 and is fixed with wood screws 82 (not illustrated in FIG. 6) inserted therein via through holes (not illustrated) formed in the flanges 77.

The girder 80 is a wooden slat (for example, a length: 900 mm, a width: 120 mm, and a thickness: 60 mm) inserted through the through holes 75 of the N support posts 70 arrayed in the X-axis direction. In the present embodiment, M girders 80 are used corresponding to the M rows of the support posts 70 arranged at the predetermined intervals in the Y-axis direction.

The joist 85 is a wooden slat (for example, a length: 876 mm, a width: 60 mm, and a thickness: 40 mm) installed across the M girders 80. The joist 85 in the present embodiment are arranged in a row along the Y-axis direction, and are laid at predetermined intervals in the X-axis direction. The joists 85 are fixed on top of the girders 80 with wood screws 86.

The deck material 90 is a wooden slat (for example, a length: 1800 mm, a width: 145 mm, and a thickness: 45 mm) laid over the joists 85. The deck materials 90 of the present embodiment are arranged in close contact with each other in the Y-axis direction, and are fixed on top of the joists 85 with wood screws 91. When all the deck materials 90 are attached onto the joists 85, the support posts 70, the girders 80, and the joists 85 are fully covered with the deck materials 90.

Figure 7:
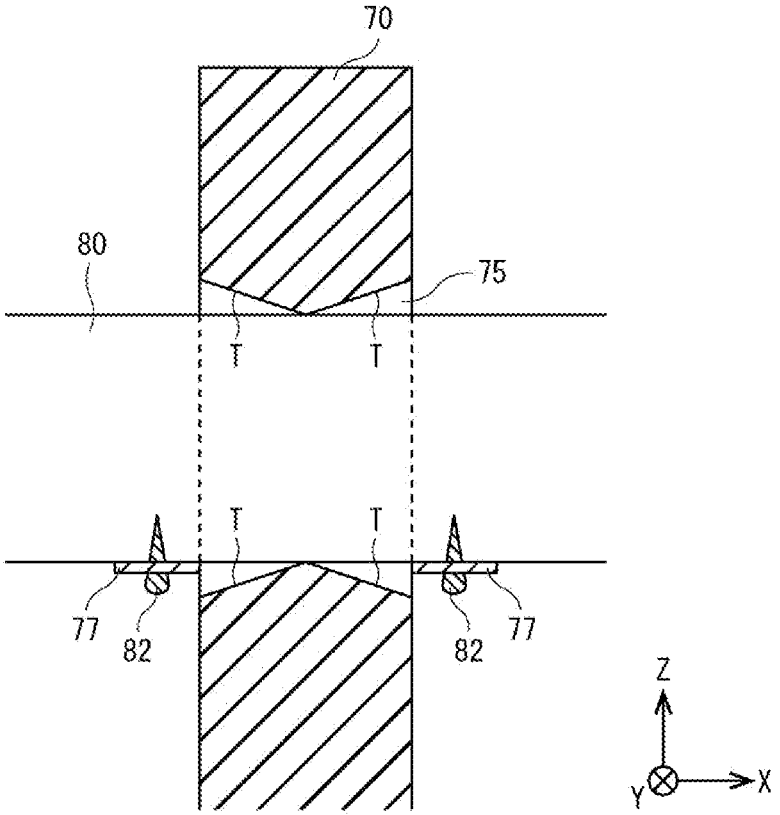
FIG. 7 is a diagram for explaining a positional relationship between each of through holes formed in a support post and a girder in the deck according to the third embodiment of the present invention.

FIG. 7 is a cross-sectional view of an area around the through hole 75 for explaining a positional relationship between the through hole 75 and the girder 80. As described above, the girders 80 in the present embodiment are inserted through the through holes 75 in the support posts 70 and are fixed with the wood screws 82 inserted therein via the through holes in the flanges 77. In this connection, when the cross-sectional shape of each of the through holes 75 is approximately equal to the cross-sectional shape of the girder 80, the contact area of the through hole 75 with the girder 80 in the process of insertion is so large that a problem arises in that it is difficult to fit the girder 80 into the through holes 75. Meanwhile, when a gap between the girder 80 and the through hole 75 is too small, there is another problem that rainwater or the like, if soaked into the girder 80 at this portion, is difficult is difficult to dry and easily rots the girder 80. To solve these problems, in the present embodiment, each of the through holes 75 has a structure in which tapered portions T at an angle of 3 to 45° are provided inside the through hole 75 and the cross section of the through hole 75 is narrow at an approximately center portion (inner side) and becomes wider toward the outside. With this structure, the contact area of the through hole 75 with the girder 80 in the process of fitting is small and accordingly it is easy to fit the girder 80 into the through holes 75 (in other words, the assembling work is easy). Then, since each through hole 75 becomes wider toward the outside, the air permeability is good. For this reason, even if rainwater or the like soaks into the girder 80 at this portion, the girder 80 is less likely to rot.

In the deck 3 of the present embodiment, the girders 80 are inserted through and fixed to the through holes 75 in the multiple support posts 70, and thereby are laid across the support posts 70 as described above. This structure only requires manufacturing of one type of support posts 70. In addition, decks 3 in various sizes can be built by increasing the numbers of support posts 70 arrayed in the X-axis direction and the Y-axis direction (in other words, a design change is easy). Further, since the support post 70 is provided with the flanges 77 protruding on both sides in the X-axis direction, the support post 70 is capable of joining two girders 80 with the support post 70 interposed in between as in the fence 2 of the second embodiment. Moreover, as in the fence 2 of the second embodiment, various designs may be applied to the support post 70 without significantly changing the position of the through hole 75 (in other word, the degree of freedom in design is high).

In the present embodiment, the example of the deck 3 has been described as the outdoor structure, but the present invention may be applied to other purposes such as a wooden path having a similar structure.

In addition, the embodiments disclosed herein should be considered to be exemplary and nonrestrictive in all the respects. The scope of the present invention is specified not by the above description but by the scope of claims, and is intended to include all modifications within the meaning and scope equivalent to the scope of claims.

REFERENCE SIGNS LIST

1 bench
2 fence
3 deck
10 frame
12 base
13, 14 leg part
15 main body
16 extension part
17*a*, 17*b*, 17*c*, 17*d*, 17*e*, 17*f*, 17*g*, 17*h*, 17*i*, 17*j*, 17*k*, 17*l* through hole
18 flange
19*a*, 19*b*, 19*c*, 19*d*, 19*e*, 19*f*, 19*g*, 19*h*, 19*i*, 19*j*, 19*k*, 19*l* notch
20 seat face
30 backrest
50 support post
55*a*, 55*b*, 55*c* through hole
57 flange
60 horizontal plate
62 wood screw
70 support post
75 through hole
77 flange
80 girder
82, 86, 91 wood screw
85 joist
90 deck material
B base
T tapered portion
W slat

The invention claimed is:

1. An outdoor structure comprising:

a plurality of metal support posts each including one or more rectangular through holes and arrayed at least in one row in a first direction; and a wooden slat laid across the through holes of the plurality of support posts, wherein a cross section of each of the through holes in the first direction includes tapered portions which are narrow at an approximately center portion and become wider toward outside.

2. The outdoor structure according to claim 1, wherein each of the support posts includes flanges along one side of the through hole, the flanges formed to protrude in the first direction and a direction opposite to the first direction, and the slat is fixed with fixing members inserted through the flanges.

3. The outdoor structure according to claim 1, wherein an angle of each of the tapered portions is 3 to 45°.

4. The outdoor structure according to claim 1, wherein a certain design is applied to each of the support posts.

5. The outdoor structure according to claim 1, wherein each of the support posts includes a plurality of the through holes arranged consecutively in an approximately L-form, a plurality of the slats are laid corresponding to the respective through holes, and the outdoor structure is a bench in which a seat face and a backrest are formed of the plurality of slats.

6. The outdoor structure according to claim 1, wherein each of the support posts includes a plurality of the through holes arranged at predetermined intervals in a vertical direction, a plurality of the slats are laid corresponding to the respective through holes, and the outdoor structure is a fence in which horizontal plates are formed of the plurality of slats.

7. The outdoor structure according to claim 1, wherein the plurality of support posts are arranged in M (M is an integer of 2 or more) rows each including N (N is an integer of 2 or more) support posts arrayed along the first direction, the M rows arranged in a second direction orthogonal to the first direction, a plurality of the slats are M girders laid across the through holes in the N support posts arrayed along the first direction, and the outdoor structure is a deck or wooden path further comprising:

a plurality of wooden joists laid across the M girders; and a plurality of wooden deck materials laid on top of the plurality of joists.

* * * * *